US008602180B2

(12) United States Patent
Centeno et al.

(10) Patent No.: US 8,602,180 B2
(45) Date of Patent: Dec. 10, 2013

(54) RAILROAD FREIGHT CAR BRAKE BEAM ASSEMBLY

(75) Inventors: Joseph Centeno, Kenosha, WI (US); Rudolph S. Fortuna, Brookfield, WI (US); Thomas H. Ekstrom, Antioch, IL (US)

(73) Assignees: Powerbrace Corporation, Kensoha, WI (US); Miner Enterprises, Inc., Geneva, IL (US)

( * ) Notice: Subject to any disclaimer, the term of this patent is extended or adjusted under 35 U.S.C. 154(b) by 912 days.

(21) Appl. No.: 12/157,041

(22) Filed: Jul. 31, 2008

(65) Prior Publication Data

US 2010/0025170 A1 Feb. 4, 2010

(51) Int. Cl.
*B61H 13/36* (2006.01)

(52) U.S. Cl.
USPC ..... 188/229.1; 188/228.1

(58) Field of Classification Search
USPC ..... 188/219.1, 229.1, 228.1; 384/276, 295
See application file for complete search history.

(56) References Cited

U.S. PATENT DOCUMENTS

| | | | | |
|---|---|---|---|---|
| 430,756 | A | | 6/1890 | Robischung |
| 800,409 | A | | 9/1905 | Sharp |
| 1,943,271 | A | | 1/1934 | Ivermeyer |
| 2,047,732 | A | | 7/1936 | Harbert |
| 2,364,021 | A | | 11/1944 | Flesch |
| 2,398,917 | A | | 4/1946 | Busch |
| 2,547,860 | A | | 4/1951 | Flesch |
| 2,570,202 | A | | 10/1951 | Busch |
| 2,930,329 | A | | 3/1960 | Busch |
| 3,690,270 | A | | 9/1972 | Gutmann, Jr. et al. |
| 3,727,280 | A | * | 4/1973 | Campbell ..... 29/898.052 |
| 4,194,599 | A | | 3/1980 | Cole |
| 4,636,106 | A | * | 1/1987 | Waisbrod ..... 403/228 |
| 4,787,129 | A | | 11/1988 | Williamson |
| 4,831,905 | A | | 5/1989 | Munchinson |
| 4,956,525 | A | | 9/1990 | Wilk |
| 5,810,124 | A | | 9/1998 | Sandmann |

(Continued)

OTHER PUBLICATIONS

International Searching Authority/USPTO; International Search Report regarding PCT/US2009/03369; Jul. 24, 2009; 2 pages.
International Searching Authority/USPTO; Written Opinion of the International Searching Authority regarding PCT/US2009/03369; Jul. 24, 2009; 7 pages.

(Continued)

*Primary Examiner* — Anna Momper
(74) *Attorney, Agent, or Firm* — Law Office of John W. Harbst

(57) ABSTRACT

A railroad freight car brake beam with a strut having a pair of generally parallel and joined side walls disposed to opposite sides of an axis of the strut and having a central hollow portion along with a longitudinally elongated slot adapted to be inclined a predetermined number of degrees from vertical for accommodating an elongated brake lever extending through the strut. Each side wall of the strut defines a bore opening to the hollow center portion and to an exterior of the strut. The bores defined by the strut are aligned relative to each other to accommodate at least a lengthwise portion of a brake lever pivot pin extending through the strut and serving to connect the brake lever to the strut. The aligned bores in the strut also define a pivot axis for the brake lever. The strut further includes a pair of bushings which journal the brake lever pivot pin. One bushing is accommodated in each bore defined by the strut. Cooperating instrumentalities inhibit inadvertent displacement of the brake pin bushings away from the axis of and relative to the strut thereby fixing the pivot axis of the brake lever relative to the strut.

4 Claims, 8 Drawing Sheets

(56) References Cited

U.S. PATENT DOCUMENTS

| | | | | |
|---|---|---|---|---|
| 6,086,258 | A * | 7/2000 | Cadle et al. | 384/294 |
| 6,155,389 | A | 12/2000 | Sandmann | |
| 6,193,028 | B1 | 2/2001 | Elizalde-Siller et al. | |
| 6,234,283 | B1 | 5/2001 | Montes-Ramos | |
| 6,238,127 | B1 * | 5/2001 | Jhumra et al. | 403/282 |
| 6,543,955 | B2 | 4/2003 | Conaway et al. | |
| 7,077,411 | B2 | 7/2006 | Peters et al. | |
| 2003/0057622 | A1 * | 3/2003 | Bovio et al. | 267/281 |
| 2006/0108187 | A1 | 5/2006 | Steffen | |
| 2007/0038783 | A1 | 2/2007 | Doran | |
| 2009/0301826 | A1 * | 12/2009 | Dalman et al. | 188/219.1 |
| 2009/0301827 | A1 * | 12/2009 | De La Pena | 188/229.1 |

OTHER PUBLICATIONS

International Searching Authority/USPTO; International Search Report regarding PCT/US2009/03406; Jul. 30, 2009; 2 pages.

International Searching Authority/USPTO; Written Opinion of the International Searching Authority regarding PCT/US2009/03406; Jul. 30, 2009; 8 pages.

International Searching Authority/USPTO; International Search Report regarding PCT/US2009/003372; Jul. 28, 2009; 2 pages.

International Searching Authoirty/USPTO; Written Opinion of the International Searching Authority regarding PCT/US2009/03372; Jul. 28, 2009; 5 pages.

* cited by examiner

RAILROAD FREIGHT CAR BRAKE BEAM ASSEMBLY

FIELD OF THE DISCLOSURE

The present disclosure generally relates to railroad freight cars and, more particularly, to a railroad freight car brake beam assembly.

BACKGROUND OF THE DISCLOSURE

Railroad freight cars typically include an elongated car body supported toward opposite ends by a pair of wheeled trucks. Each wheeled truck includes a bolster laterally extending between two side frames with a wheel and axle assembly arranged to front and rear sides of the bolster. Each railcar also has a brake system operably associated therewith. A conventional brake system includes a brake beam assembly associated with each wheel and axle assembly and which is connected to brake rigging on the railcar. Each brake beam assembly is supported between the truck side frames to allow it to be operated into and out of braking positions in relation to the respective wheel and axle assembly.

One form of brake beam assembly commonly used in the railcar industry includes a compression member and a tension member arranged in a truss-like configuration with a strut extending therebetween. A brake head, with a replaceable brake shoe, is arranged at each end of the brake beam assembly. It has been found beneficial for the brake beam assembly to maintain both a degree of camber in the compression member and a degree or level of tension in the tension member.

Brake beam assemblies on the railcar are typically operated in simultaneous relation by a power source from a brake cylinder or a hand brake and, through leverage, transmit and deliver braking forces to the brake shoes at the wheels of each wheel and axle assembly. On a typical railcar, brake rigging, including a brake push rod, transmits force, caused by the push of air entering the brake cylinder or by the pull of the hand brake, to the brake shoes.

The brake rigging on the railcar, used to transmit and deliver braking forces to the braking shoes of each wheel assembly, comprises a multitude of linkages including various levers, rods and pins. For example, brake levers are used throughout the brake rigging on each car to transmit as well as increase or decrease the braking force on each wheel and axle assembly A conventional strut on a railroad freight car brake beam assembly has a hollow center portion with two joined sides or walls, with one side or wall being arranged on opposite sides of a longitudinal axis of the strut. When assembled, the strut is operably connected to the tension and compression members proximate midlength of such members. A conventional strut has an axially elongated and generally centralized, close-ended slot between the two sides or walls thereof. Typically, a central portion of a brake lever extends through and is pivotally mounted in the slot between the opposed sides of the strut. Besides being pivotally supported by the strut, opposite ends of the brake lever are articulately connected through suitable connections to the railcar brake rigging. About midlength thereof, the strut defines two openings or bores aligned along an axis extending generally normal to the longitudinal axis of the strut. A brake lever pivot pin passes endwise through the bores and through the central portion of the brake lever to define an axis about which the brake lever pivots during railcar operation.

To lower the upper end of the brake lever relative to the position it would occupy if the brake lever were vertical, such brake levers are inclined lengthwise of the brake beam a certain number of degrees, usually about 40°. The strut is designed to accommodate suitable inclination of the brake lever from vertical. To reduce strut wear and to facilitate operation of the brake beam assembly during operation of the railcar, it is known to provide the strut with two brake pin bushings seated in the bores of the strut and which journal a lengthwise portion of the brake lever pivot pin for the brake beam.

During use, a railcar can travel tens of thousands of miles between locations and over railbeds, some of which can be in significant disrepair. During railcar travel, the brake lever and related parts of the braking system are subject to vibration and wear. Accordingly, it is not unusual for one or more of the brake pin bushings to unseat from its respective bore and separate from the strut. The inclination of the bushings from vertical, coupled with gravity, also tends to cause at least one of the brake pin bushings to remove itself from the respective bore in the strut. Moreover, current research shows the brake pin bushings are exposed to forces and components of forces acting in a direction working to unseat or displace the brake pin bushings from their respective bore and be driven the out of position relative to the strut.

In some designs, the brake pin bushings are fabricated from a powder sintered metal. Unless powder sintered metal bushings are properly seated within their respective strut bore, such bushings can crack as they become displaced from their respective strut bore. Moreover, and even if such brake pin bushings remain partially seated in the strut bore, the powder sintered metal bushing is prone to chipping. Wear on the brake pin bushings can change the disposition about which the brake lever pivots, thus, changing the pressure exerted by the brake pads to the railcar wheels. Moreover, and under the rules of the American Association of Railroads (the "AAR"), bushing wear and cracking can result in condemnation of the brake beam assembly.

For a myriad of reasons, railroad freight cars are routinely inspected. Part of the inspection process involves an analysis of each railcar brake beam assembly on the railcar. When a particular railroad freight car is identified as having a brake beam assembly requiring repair or replacement, the freight car requiring such repair is usually separated from the remaining cars in the train consist and, then, moved to a facility where such repairs can be affected. Only after a suitable repair facility has been identified and becomes available, can replacement of a condemned brake beam assembly be affected.

Replacing a railcar brake beam assembly, for whatever reason, can be a time consuming process. Moreover, the valuable time lost in separating the railcar with the condemned brake beam from the remaining cars in the train consist, coupled with the time lost in scheduling a repair facility to accomplish replacement of the brake beam assembly, and the valuable time lost in affecting the repair or replacement of the condemned brake beam, along with the time lost in having to move the car with the condemned brake beam to the repair facility for replacement of the brake beam assembly are other considerations and unrealized costs involved with replacing a condemned brake beam. Of course, during this entire time period, the railcar is removed from service. Replacement of the condemned brake beam must also include the time lost in joining the repaired car to a train consist directed toward the original destination of the repaired car.

Thus, there is a continuing need and desire for a railroad freight car brake beam assembly comprised of components designed for extended wear thereby reducing the time and expense the railcar can be out of service due to a faulty brake beam assembly.

SUMMARY OF THE DISCLOSURE

In view of the above, and in accordance with one aspect, there is provided a railroad freight car brake beam assembly including a tension member and a compression member connected to each other toward opposite ends. A first brake shoe carrying brake head is operably arranged toward a first end of the compression member and the tension member. A second brake shoe carrying brake head is operably arranged toward a second end of the compression member and the tension member. The railroad freight car brake beam assembly also includes a strut operably connected at opposite ends to the tension member and the compression member. The strut defines a longitudinal axis and has an axially elongated slot defined between first and second sides thereof. The slot in the strut is inclined a predetermined number of degrees from vertical for accommodating an elongated brake lever extending through the strut. Each side of the strut defines a bore opening to the slot. The bores defined by the sides on the strut are aligned relative to each other and accommodate a lengthwise portion of a brake lever pivot pin extending through the strut thereby connecting the brake lever to the strut and so as to define an axis about which the brake lever pivots. The strut for the railroad freight car brake beam assembly further includes a pair of bushings. One bushing is accommodated in each bore defined by the strut so as to journal the pivot pin. The railroad freight car brake beam assembly strut further includes cooperating instrumentalities for inhibiting displacement of the bushings away from the longitudinal axis of and relative to the strut thereby fixing the pivot axis of the brake lever relative to the strut.

In one form, each bushing in the railroad freight car brake beam assembly strut is sized relative to the bore in the strut such that an interference fit is established between a periphery of each bushing and an inside diameter of the bore in said railroad freight car brake beam assembly strut. In one form, the cooperating instrumentalities for inhibiting movement of the bushings away from the longitudinal axis of and relative to the strut includes an anaerobic, low viscosity, high shear strength chemical compound for filling microscopic voids between a periphery of each bushing and an inside diameter of each bore in the strut.

In another form, the cooperating instrumentalities for inhibiting movement of the bushings away from the axis of and relative to the strut includes an interrupted surface extending about a periphery of each bushing. In one form, the interrupted surface extending about a periphery of each bushing comprises a series of radially spaced splines. The splines can take a myriad of shapes. In one form, a majority of the splines have a helical configuration.

In another embodiment, each brake pin bushing includes two operably interconnected pieces. In this form, the cooperating instrumentalities for inhibiting movement of the bushings away from the longitudinal axis of and relative to said strut includes structure on at least one bushing piece for inhibiting shifting or inadvertent displacement of the interconnected bushing pieces away from the longitudinal axis of the strut.

According to another aspect, there is provided a railroad freight car brake beam assembly having two ends and includes a tension member and compression member arranged in a truss-like configuration relative to each other. The truss-like configured tension member and compression member have one brake head connected toward distal ends thereof. An elongated strut is operably connected at opposite ends to and between the tension member and the compression member. The strut has a longitudinal centerline and a closed ended slot defined between first and second side walls. The slot in the brake beam strut is inclined a predetermined number of degrees from vertical for accommodating an elongated brake lever extending through the strut. Each side or wall of the brake beam strut defines a bore opening to the slot and to an exterior of the strut. The bores defined by the side walls on the strut are aligned relative to each other to accommodate a lengthwise portion of a brake lever pivot pin extending through the strut thereby connecting the brake lever to the strut and so as to define an axis about which the brake lever pivots. The brake beam strut further includes a pair of bushings which journal the pivot pin. One bushing is accommodated in each bore defined by the strut. Moreover, the strut includes cooperating instrumentalities for inhibiting inadvertent displacement of the bushings away from the centerline and relative to the strut thereby fixing the pivot axis of the brake lever relative to the strut.

Preferably, each bushing is sized relative to the bore in the strut such that an interference fit is established between a periphery of the bushing and an inside diameter of the strut bore. In this form, the cooperating instrumentalities for inhibiting movement of the bushings away from the longitudinal centerline of and relative to the strut includes an anaerobic, low viscosity, high shear strength chemical compound for filling microscopic voids between a periphery of each bushing and thereby bonding each bushing to an inside diameter of the bore in the strut.

In an alternative embodiment, the cooperating instrumentalities for inhibiting movement of the bushings away from the longitudinal axis of and relative to the strut includes an interrupted surface extending about a periphery of the bushing. In one form, the interrupted surface extending about a periphery of the bushing comprises a series of radially spaced splines. In one embodiment, a majority of the splines have a helical configuration.

In another form, the each bushing includes two operably interconnected pieces. In this form, the cooperating instrumentalities for inhibiting movement of the bushings away from the longitudinal axis of and relative to the strut includes structure on one bushing piece for inhibiting shifting of the bushing pieces away from the longitudinal axis of the strut.

According to another aspect, there is provided a railroad freight car brake beam with a strut having a pair of generally parallel sides disposed to opposite sides of a longitudinal centerline of the strut and defining an elongated and closed ended passage which is inclined a predetermined number of degrees from vertical for accommodating an elongated brake lever extending through the strut. Each side of the strut defines a bore opening at a first end to the passage and at a second end to an exterior of the strut. The bores defined by the sides on the strut are aligned relative to each other to accommodate a lengthwise portion of a brake lever pivot pin extending through the strut thereby connecting the brake lever to the strut. The aligned bores in the strut also define a pivot axis for the brake lever. The strut further includes a pair of bushings which journal the pivot pin. One bushing is accommodated in each bore defined by the strut. The strut further includes cooperating instrumentalities for inhibiting movement of the bushings away from the centerline and relative to the strut thereby fixing the pivot axis of the brake lever relative to the strut.

In one embodiment, each bushing in the railroad freight car brake beam strut is sized relative to the respective strut bore such that an interference fit is established between a periphery of each bushing and an inside diameter of the strut bore. In one form, the cooperating instrumentalities for inhibiting movement of the bushings away from the longitudinal axis of and relative to the strut includes an anaerobic, low viscosity, high shear strength chemical compound for filling voids between a periphery of each bushing and an inside diameter of each strut bore.

In another form, the cooperating instrumentalities for inhibiting movement of the bushings away from the axis of and relative to the strut includes an interrupted surface extending about a periphery of each bushing. In one form, the interrupted surface extending about a periphery of each bushing comprises a series of radially spaced splines. The splines can take a myriad of shapes. In one form, a majority of the splines have a helical configuration.

In another embodiment, each brake pin bushing includes two operably interconnected pieces. In this form, the cooperating instrumentalities for inhibiting movement of the bushings away from the longitudinal axis of and relative to said strut includes structure on at least one bushing piece for inhibiting shifting of the interconnected bushing pieces away from the longitudinal axis of the strut.

DETAILED DESCRIPTION OF THE DRAWINGS

DETAILED DESCRIPTION OF THE DISCLOSURE

Figure 1:
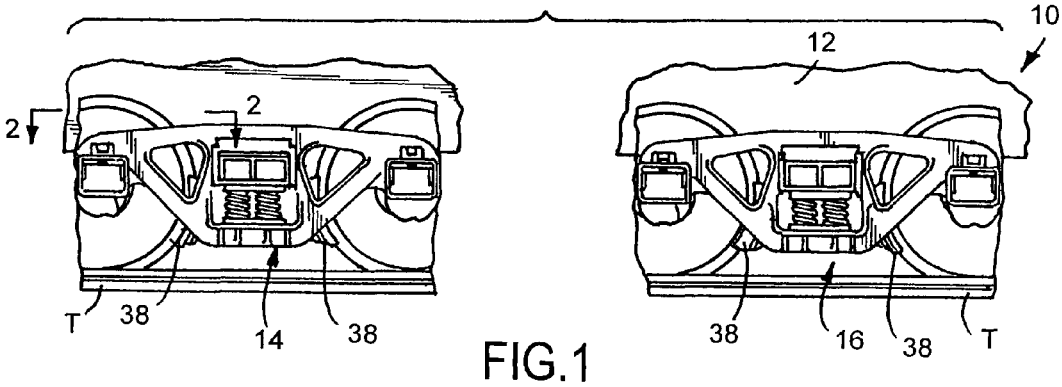
FIG. 1 is a fragmentary side elevational view of a railroad car having railroad car trucks arranged toward opposite ends thereof.

While the present disclosure is susceptible of embodiment in multiple forms, there is shown in the drawings and will hereinafter be described preferred embodiments of the disclosure, and the present disclosure is to be considered as setting forth exemplifications which are not intended to limit the disclosure to the specific embodiments illustrated and described.

Referring now to the drawings, wherein like reference numerals indicate like parts throughout the several views, FIG. 1 shows a railroad freight car 10 including a car body 12. Typically, the car body 12 is supported, toward opposite ends thereof, in operable combination with a pair of wheeled trucks 14 and 16 for movement over tracks T. The wheeled trucks 14, 16 are substantially similar to each other and, thus, only wheeled truck 14 will be discussed in detail.

Figure 2:
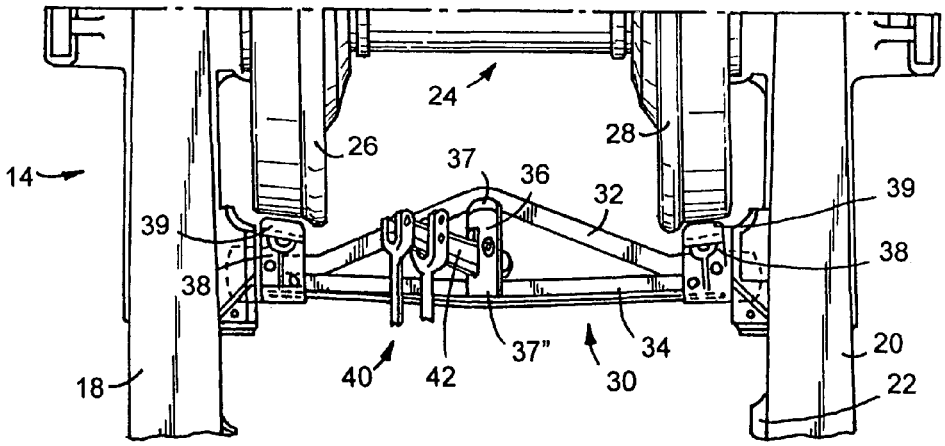
FIG. 2 is a fragmentary plan view of a brake beam assembly associated with one of the railroad car trucks shown in FIG. 1.

As shown in FIG. 2, each wheeled truck includes a pair of side frames 18 and 20 with a bolster 22 extending laterally therebetween and upon which car body 12 (FIG. 1) is pivotally supported. The side frames 18, 20 are usually of one-piece construction and formed from cast steel. Although only one is partially shown in FIG. 2, those skilled in the art will appreciate a conventional wheel and axle assembly 24 is provided on each side of the bolster 22 between the side frames 18, 20 and in operable combination with each truck. As is typical, each wheel and axle assembly 24 includes a pair of laterally spaced and flanged wheels 26 and 28.

Each wheel and axle assembly 24 on railcar 10 has a brake beam assembly 30 arranged in operable combination therewith. In the illustrated embodiment, the side frames 18, 20 on each truck conventionally guide and support the brake beam assembly 30 for generally horizontal sliding movements. As shown in FIG. 2, a conventional brake beam assembly 30 includes several interrelated components including a tension member 32, a compression member 34, and a strut 36. In the illustrated embodiment, the tension member 32 and compression member 34 are arranged in a truss-like configuration and laterally extend between the two side frames 18 and 20 for guided movements.

Typically, each brake beam assembly 30 has a brake head 38 with friction brake shoes 39 disposed toward opposed ends thereof for engagement with the respective wheels 26, 28 of an associated wheel and axle assembly. The brake shoes 39 are moved into and out of braking relation with the wheels 26, 28 of a respective wheel and axle assembly through brake rigging, generally identified in FIG. 2 by reference numeral 40, which is responsive to operation of an air cylinder (not shown) or a hand brake mechanism (not shown).

The strut or fulcrum 36 of the brake beam assembly 30 shown in FIG. 2 is generally centralized along the lengths of and is operably connected toward opposite ends to the tension member 32 and compression member 34 in a conventional manner. In operation, the strut 36 holds member 34 to its camber and member 32 to its bowed shape. A brake lever 42 forming part of the brake rigging 40 is fulcrumed intermediate opposite ends thereof in each strut 36.

Figure 3:
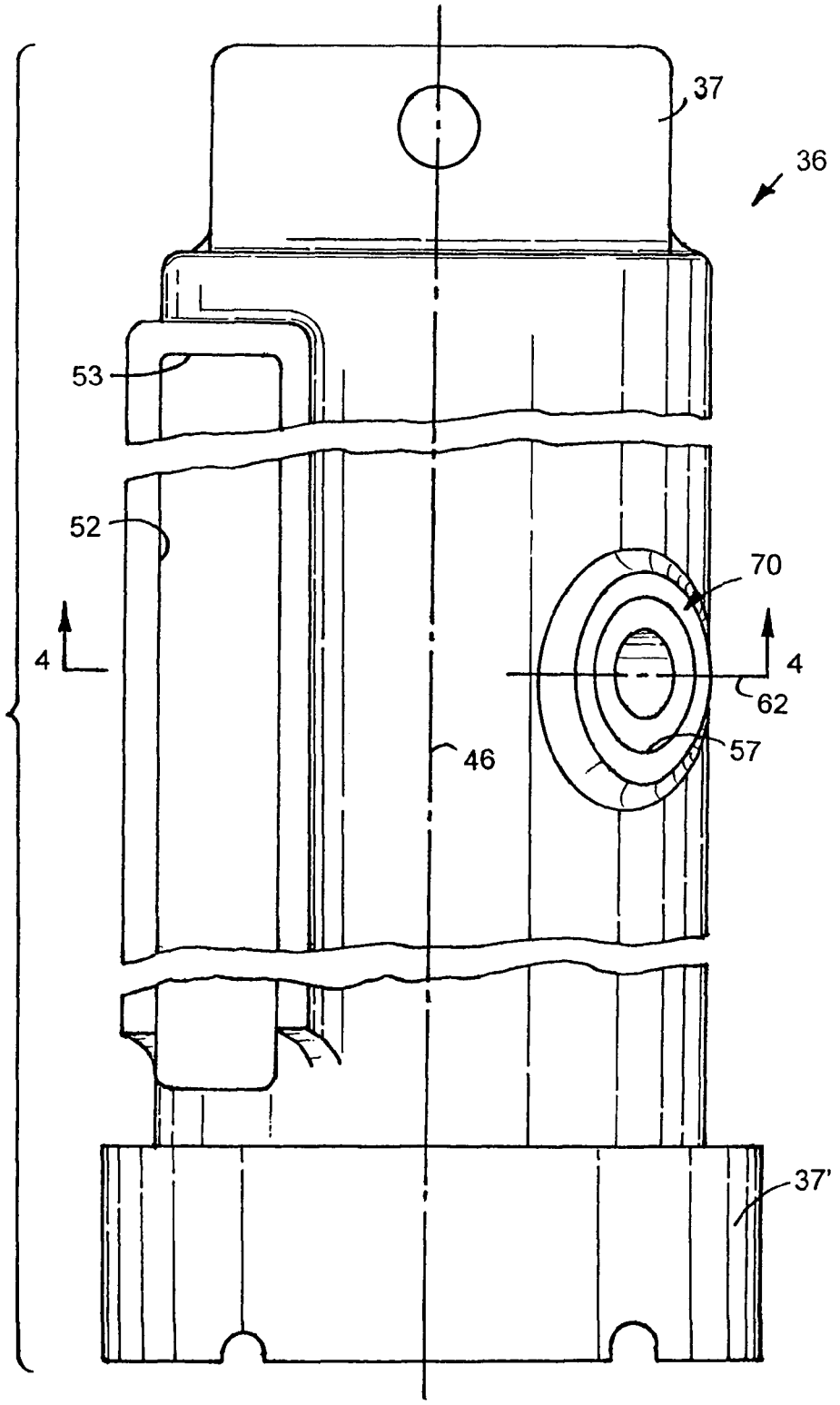
FIG. 3 is an enlarged plan view of a brake beam strut embodying principals of the present disclosure.

As shown in FIG. 3, strut 36 has an elongated axis 46 and a hollow center portion 41. Strut 36 defines an elongated slot 52 having a closed margin 53. The slot 52 in strut 36 allows the brake lever 42 (FIG. 4) to extend endwise through the strut 36. Strut 36 furthermore has a first end 37 configured for suitable attachment to the tension member 32 and second end 37' configured for suitable attachment to compression member 34.

Figure 4:
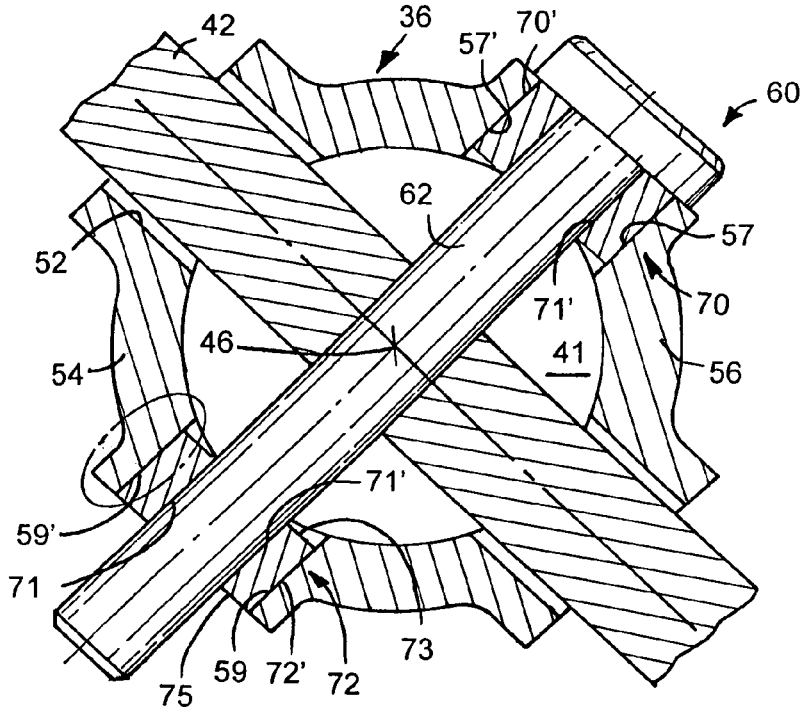
FIG. 4 is sectional view taken along line 4-4 of FIG. 3.

As shown in FIG. 4, strut 36 includes first and second generally parallel and joined sides or walls 54 and 56 disposed to opposed sides of the elongated axis 46 and defining the hollow portion 41 and slot 52 therebetween. To lower the upper end of the brake lever 42, and after the strut 36 is operably connected to tension member 32 and compression member 36 (FIG. 2), slot 52 is inclined a predetermined number of degrees from vertical. In form, and after the strut 36 is operably connected to members 32 and 34, slot 52 is inclined about 40° from vertical.

As shown in FIG. 4, each side wall 54 and 56 of the strut 36 defines a bore 57 and 59, respectively. Each bore 57, 59 opens to the hollow center portion 41 and to an exterior of the strut 36. The bores 57, 59 defined by strut 36 are aligned relative to each other and accommodate a lengthwise portion of a brake lever pivot pin 60 extending through the strut 36 and thereby connecting the brake lever 42 to the strut 36 and so as to define an axis 62 about which the brake lever 42 pivots during operation of the brake lever assembly 30 (FIG. 2). Preferably, the axis 62 about which brake lever 62 pivots extends generally normal to and, preferably, intersects with the elongated axis 46 of strut 36.

To reduce wear on the strut 36 resulting from continuous pivoting movements of the brake lever 42 about axis 62 during operation of the railcar, strut 36 further includes a pair of brake pin bushings 70 and 72. The bushings 70 and 72 are accommodated in the bores 57 and 59, respectively, of the strut 36 so as to journal a lengthwise portion of the brake lever pivot pin 60 extending therethrough. Preferably, the brake pin bushings 70 and 72 are substantially identical relative to each other and are fabricated from a sintered powdered material.

As shown in FIG. 4, the bores 57 and 59 in the brake beam assembly strut 36 each have an inner diameter 57' and 59', respectively. Preferably, each brake pin bushing 70, 72 has a generally cylindrical outer periphery and, thus, an outer diameter 70' and 72', respectively, extending between first and second axially spaced and generally parallel surfaces 73 and 75. The surfaces 73 and 75 are axially spaced from each other a distance generally equal, slightly greater, or slightly less than a distance measurable between an inner end (disposed closest to the axis 46 of strut 36) of each strut bore 57, 59 and an exterior end (disposed farthest from the axis 46 of strut 36) of each strut bore 57, 59.

The outer diameter 70', 72' of the respective brake pin bushings 70, 72 are sized such that an interference fit is established between the outer diameter 70', 72' of each brake pin bushings 70, 72 and the inner diameter 57', 59' of the respective strut bores 57, 59 into which the brake pin bushings 70, 72 are pressed. In one form, the outer diameter 70', 72' of the brake pin bushings 70, 72 initially ranges in size to be about 0.004 to about 0.018 inches larger in diameter than the inner diameters 57', 59' of the bores 57, 59. In a most preferred form, the outer diameter 70', 72' of each brake pin bushing 70, 72 is initially about 0.013 inch larger in diameter than the inner diameter 57', 59' of the bores 57, 59. Each brake pin bushing 70, 72 also has an inner diameter 71 defined by a throughbore 71' sized relative to that portion of the brake lever pivot pin 60 passing therethrough.

Figure 5:
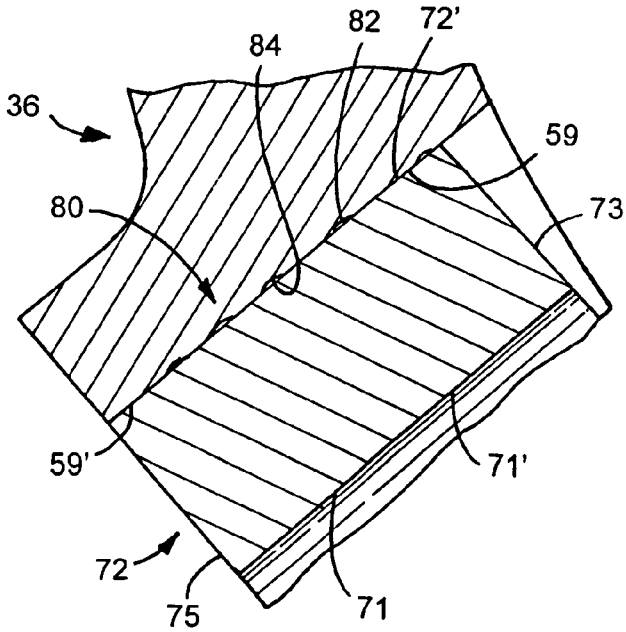
FIG. 5 is a fragmentary and enlarged sectional view of the area encircled in FIG. 4 by phantom lines.

To inhibit inadvertent axial displacement of the brake pin bushings away from the longitudinal axis 46, strut 36 further includes cooperating instrumentalities, generally identified by reference numeral 80 in FIG. 5. Since the brake pin bushings 70, 72 are substantially identical, the cooperating instrumentalities 80 associated only with brake pin bushing 72 will be discussed in detail. In one form, the cooperating instrumentalities 80 includes an anaerobic, low viscosity, high shear strength chemical compound 82 for filling microscopic voids 84 between the outer diameter 72' of the brake pin bushing 72 and the inner diameter 59' of the receptive bore 59 in the strut 36. One form of anaerobic, low viscosity, high shear strength chemical compound which appears to work well is that sold by Henkel Corporation under the tradename "Loctite".

Figure 6:
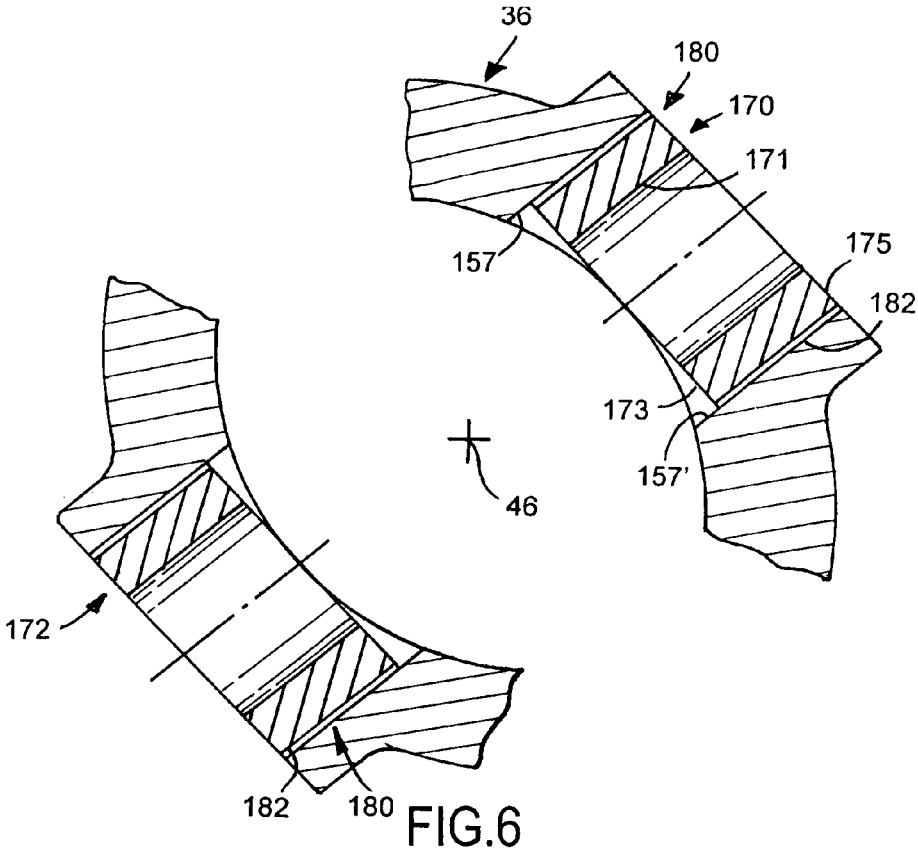
FIG. 6 is a fragmentary and enlarged sectional view similar to that shown in FIG. 4 showing an alternative brake pin bushing arrangement.

FIG. 6 illustrates alternative cooperating instrumentalities for inhibiting inadvertent axial displacement of the brake pin bushings away from the longitudinal axis 46 of the strut 36. This alternative form of cooperating instrumentalities is designated generally in FIG. 6 by reference numeral 180. The elements of the strut arranged in operable combination with the this alternative form of cooperating instrumentalities that are functionally analogous to those component discussed above regarding strut 36 are designated by reference numerals identical to those listed above with the exception this embodiment uses reference numerals in the 100 series.

In the embodiment illustrated in FIG. 6, the cooperating instrumentalities 180 for limiting displacement of the brake pin bushings 170, 172 away from the longitudinal axis 46 of the strut 36 involves providing an interrupted surface 182 extending about the outer periphery of each brake pin bushing 170, 172. In the illustrated embodiment, the interrupted surface 182 extending about each bushing 170, 172 is substantially identical. Accordingly, only the interrupted surface 182 extending about brake pin bushing 170 will be discussed in detail. As used herein and throughout the phrase "interrupted surface" means and refers to configuring the outer periphery of each brake pin bushing 170, 172 with a plurality or series of periodic or intermittent undulations arranged in predetermined relation relative to each other and extending about the periphery of the brake pin bushing.

Figure 7:
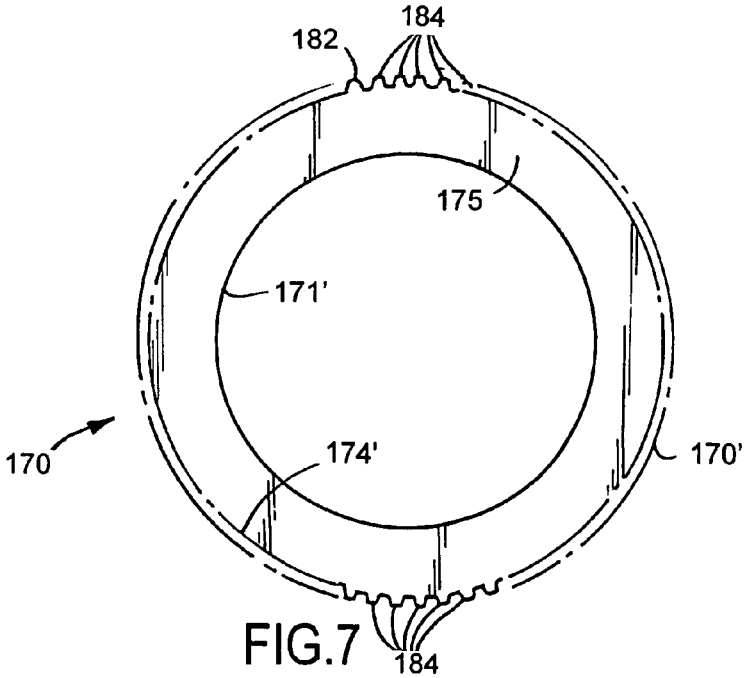
FIG. 7 is an enlarged plan view of one form of brake pin bushing.
Figure 8:
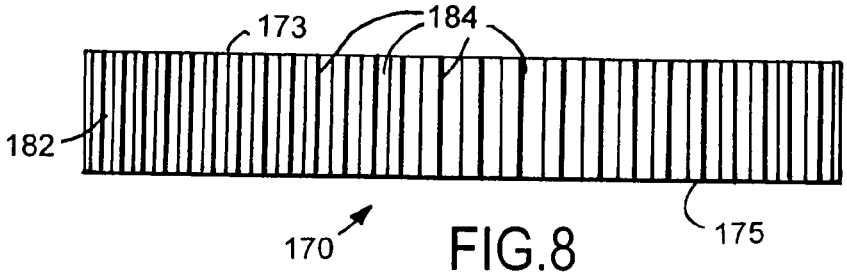
FIG. 8 is side elevational view of the brake pin bushing illustrated in FIG. 7.

As shown in FIG. 7, the interrupted surface 182 extending about the periphery of bushing 170 includes a series of generally parallel, radially spaced and raised ribs or splines 184 about the periphery of the brake pin bushing 170. In the embodiment shown by way of example in FIG. 8, the ribs or splines 184 are formed integral with the remainder of each bearing and extend a majority of the distance between and generally normal to the generally parallel surfaces 173 and 175 on the brake pin bushing 170. Returning to FIG. 7, an outer diameter 170' of the bearing 170 is measured between a radial outermost edge of two diametrically opposed ridges or ribs 184 on the interrupted surface 182 of the bearing 170.

To further enhance the ability to limit displacement of the bushings 170, 172 away from the longitudinal axis 46 (FIG. 6), the outer diameter 170' of brake pin bushing 170 is sized such that an interference fit is established between the outer diameter 170' of the brake pin bushing 170 and the inner diameter 157' of the respective bore 157 in the strut 36 (FIG. 6) into which the brake pin bushing 170 is pressed. In one form, the outer diameter 170' of the brake pin bushing 170 initially ranges in size to be about 0.004 to about 0.018 inches larger in diameter than the inner diameter 157' of the strut bore 157 into which the bushing 170 is pressed. In a most preferred form, the outer diameter 170' of brake pin bushing 170 is initially about 0.013 inch larger than are the inner diameter 157' of the strut bore 157 into which the bushing 170 is pressed. Notably, however, the root diameter 174' (FIG. 7), that is the diameter measured between a radial innermost edge of two diametrically opposed ridges or ribs 184 on the interrupted surface 182 of the bearing 170, is less than the inner diameter 157' of the respective bore 157 into which the brake pin bushing 170 is pressed. The inner diameter 171' of each brake pin bushing 170, 172 is sized to journal that portion of the brake lever pivot pin 60 passing through the bushings 170, 172 and about axis 162.

Figure 9:
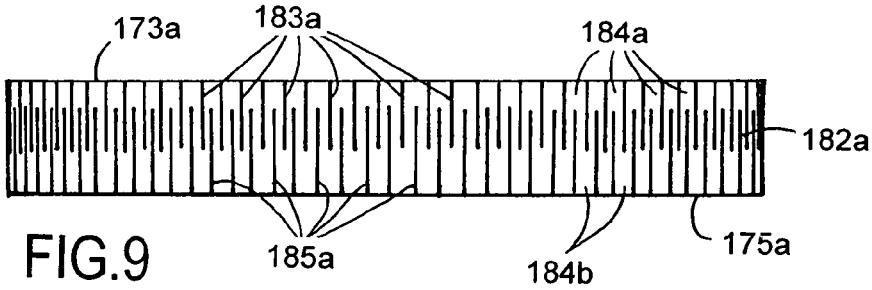
FIG. 9 is a side elevational view similar to FIG. 8 showing an alternative brake pin bushing design.

FIG. 9 shows an alternative form of interrupted surface **182*a* for the brake pin bushing. Again, and since the brake pin bushings 170, 172 are substantially similar, only brake pin bushing 170 will be discussed in detail. In the example shown in FIG. 9, the interrupted surface 182*a* for the brake pin bushing 170 includes two sets of splines or raised ribs 183*a*** and 185*a*. The first set of splines 183*a* is comprised of radially spaced and raised ribs or splines 184*a* extending about the periphery of the brake pin bushing 170. In the embodiment shown by way of example in FIG. 9, the ribs or splines 184*a* of the first spline set 183*a* are formed integral with the remainder of the bearing 170 and linearly extend away from and generally normal to bushing surface 173*a*. In the illustrated embodiment, the splines or raised ribs 184*a* linearly extend away from surface 173*a* for a predetermined distance between bushing surfaces 173*a* and 175*a*. Preferably, the splines or raised ribs 184*a* of spline set 183*a* linearly extend away from bushing surface 173*a* for about one half the distance between bushing surfaces 173*a* and 175*a* on the brake pin bushing 170.

The second set of splines 185*a* is also comprised of a series of radially spaced and raised ribs or splines 184*b* extending about the periphery of the brake pin bushing 170. In the embodiment shown by way of example in FIG. 9, the ribs or splines 184*b* are formed integral with the remainder of the bearing and linearly extend away from and generally normal to bushing surface 175*a* in radially offset relation relative to the splines 184*a*. In the illustrated embodiment, the splines or raised ribs 184*b* of spline set 185*a* linearly extend way from bushing surface 175*a* for a predetermined distance between bushing surfaces 173*a* and 175*a*. Preferably, the splines or raised ribs 184*b* of spline set 185*a* linearly extend away from bushing surface 175*a* for about one half the distance between surfaces 173*a* and 175*a* on the brake pin bushing 170.

The sizing of the interrupted surface 182*a* is such that the outer and root diameters of the spline sets 183*a* and 185*a* relative to the inner diameter 157' of the bore 157 defined by strut 36 (FIG. 6) is substantially similar to that discussed above regarding the splines or ribs 184 comprising interrupted surface 182.

Figure 10:
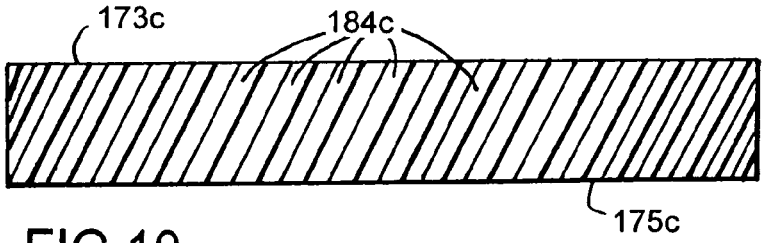
FIG. 10 is a fragmentary and enlarged view of a brake pin bushing inserted into the brake beam strut.

Rather than having a generally straight or linear configuration as shown in FIGS. 6 through 9, and as shown by way of example in FIG. 10, it is also contemplated that the interrupted surface extending about the periphery of each brake pin bushing be comprised of a series of splines 184*c* having other than a linear or generally straight configuration extending at least partially if not entirely between the bushing surfaces 173*c* and 175*c*. In one form, a majority of the splines 184*c* comprising the interrupted surface can have a helical-like configuration in plan and equally serve to limit displacement of the brake pin bushings away from the longitudinal axis 46 of the strut 36 (FIG. 6). Since each brake pin bushing is preferably fabricated from a sintered metal powder, the possible spline configurations extending about the periphery of each brake pin bushing can vary from that shown by way of example without significantly detracting or departing from the spirit and novel concept of the present disclosure. The sizing of the outer and root diameters of the splines 184*c* relative to the inner diameter 157' of the bore 157 defined by strut 36 (FIG. 6) is substantially similar to that discussed above regarding the splines or ribs 184.

Figure 11:
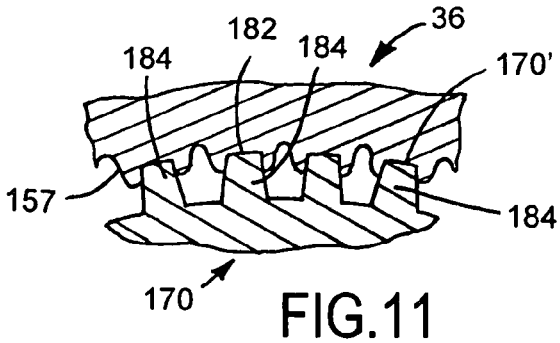
FIG. 11 is fragmentary and enlarged sectional view showing a portion of the brake pin bushing in operable combination with the strut.

Regardless of which particular spline configuration is selected for the interrupted surface extending about the periphery of the each brake pin bushing, and as shown in greater detail FIG. 11, pressing interrupted surface 182 of the brake pin bushing 170 into the bore 157 of the strut 36 causes material movement or deformation of the splines 184 and deformation of the strut 36 along and about the splines 184 to create a mechanically interrupted mating surface or area therebetween for limiting the brake pin bushing 170 against movement or displacement away from the longitudinal axis 46 of the strut 36 (FIG. 6). As the brake pin bushing 170 is pressed into the bore 157 in the strut 36, discrete movement or displacement of strut material about the splines 184 of the interrupted surface 182 occurs thus enhancing securement of the brake pin bushing 170 relative to the strut 36 as a result of the bushing splines 184 coacting with the strut. Configuring the surface interruption on the brake pin bushing in the manner described above, i.e., with the outer diameter of the brake pin bushing initially sized larger than the inner diameter of the bore in the strut and the root diameter of the splines forming the interrupted surface being sized less than the inner diameter of the strut bore advantageously allows for material displacement between the interrupted surface and the strut.

Figure 12:
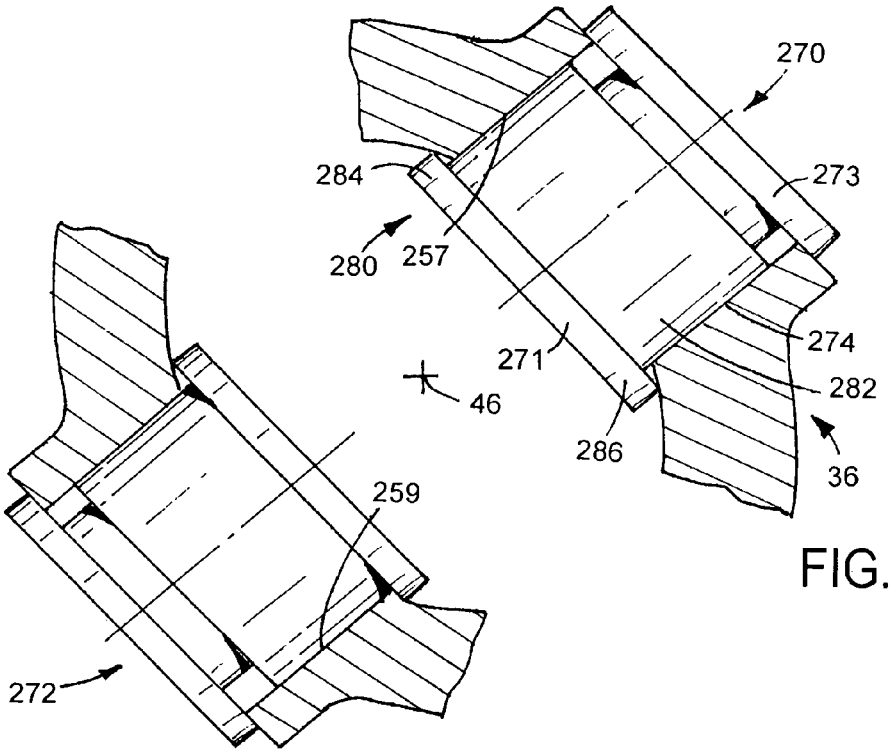
FIG. 12 is a fragmentary and enlarged sectional view similar to FIG. 6 showing an alternative brake pin bushing design.

FIG. 12 illustrates an alternative form of a brake beam strut having brake pin bushings for journalling the brake pin 60 (FIG. 4) and is specifically configured to inhibit inadvertent axial displacement or movement of either brake pin bushing relative to the strut 36 and away from the longitudinal axis 46 of the strut 36. This alternative form of brake pin bushing is designated generally in FIG. 12 generally by reference numeral 270 and 272. The elements of the strut arranged in operable combination with the this alternative form of brake pin bushing that are functionally analogous to those component discussed above regarding bushings 70 and 72 are designated by reference numerals identical to those listed above with the exception this embodiment uses reference numerals in the 200 series.

Preferably, the brake pin bushings 270, 272 are substantially identical relative to each other with bushing 270 being accommodated in strut bore 257 and bushing 272 being accommodated in strut bore 259. Accordingly, only bushing 270 will be discussed in detail. As shown in FIG. 12, bushing 270 includes two operably interconnected pieces 271 and 273. As shown, the outer diameter 274 of piece 271 is sized such that it closely or snugly fits within the strut bore 257. In the illustrated embodiment, and after being inserted into the respective bore of the strut 36, the pieces 271 and 273 of bushing 270 are interconnected in operable combination relative to each other to inhibit axial shifting of one piece relative to the other. For example, pieces 271 and 273 can be threadably interconnected along at least a portion of their lengths. It is contemplated, however, other types of conventional interconnecting devices other than a threaded connection therebetween can be used to operably interconnect bushing pieces 271 and 273 to each other without detracting or departing from the spirt and novel concept of the present disclosure.

To inhibit inadvertent axial displacement of the brake pin bushings 270, 272 away from the axis 46, each bushing 270, 272 further includes cooperating instrumentalities, generally identified in FIG. 12 by reference numeral 280. In the form shown in FIG. 12, the cooperating instrumentalities 280 includes structure on at least one of the pieces 271, 273 of each bushing 270, 272 for inhibiting shifting displacement of the interconnected bushing pieces 271, 273 away from the longitudinal axis 46 of the strut 36 after the bushings 270, 272 have been arranged in operable combination with the strut 36.

Figure 13:
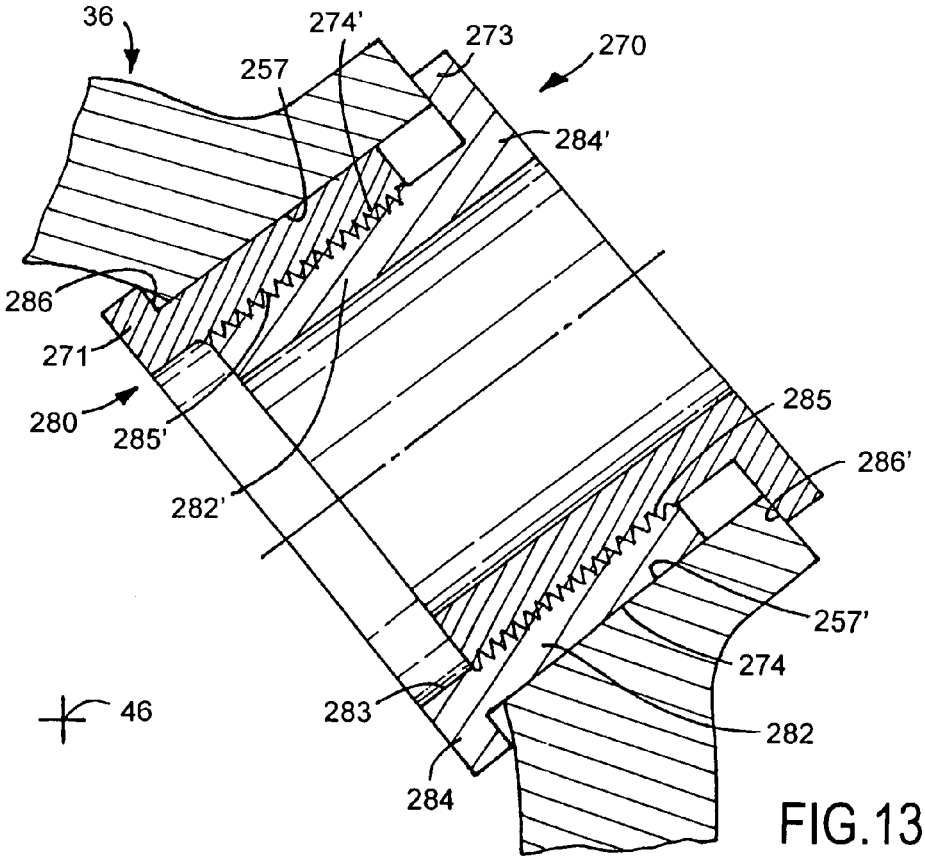
FIG. 13 is an enlarged longitudinal sectional view of one of the brake pin bushings shown in FIG. 12.

In the illustrated embodiment, part of bushing piece 271 is formed with cooperating instrumentalities 280 for inhibiting axial displacement of the brake pin bushing beyond a predetermined limit. More specifically, and in the example illustrated, bushing piece 271 is preferably configured with a shank portion 282 and a head portion 284 arranged toward one end of the shank portion 282 and, preferably, integrally formed therewith. In one form, the outer diameter of the shank portion 282 of bushing piece 271 is sized to establish a snug and, preferably, a press fit relative to the inner diameter 257' of bore 257. As shown in FIG. 13, when properly inserted into bore 257 of strut 36, the head portion 284 of bushing piece 271 is disposed closest to the strut axis 46. Bushing piece 271 defines a bore 283 extending therethrough and having suitable internal threading 285 provided along at least a length thereof. A radial and annular shoulder 286 is formed at the conjuncture of the shank portion 282 and head portion 284. Notably, the head portion 284 of bushing piece 271 is configured and sized to inhibit head portion 284 of bushing piece 271 from passing into the bore 257 of strut 36.

In the illustrated example shown in FIG. 13, bushing piece 273 is inserted from the opposite end of the strut bore 257 for operable combination with piece 271. In the form shown, piece 273 is configured with a shank portion 282' and a head portion 284' arranged toward one end of the shank portion 282' and, preferably, integrally formed therewith. The shank portion 282' of bushing piece 273 defines a bore 283' extending through piece 272 and sized to journal that portion of the brake lever pivot pin 60 (FIG. 4) extending through bushing piece 273. The shank portion 282' of bushing piece 273 also has an outside diameter 274' having suitable external threading 285' provided along at least a lengthwise portion thereof and which is adapted to cooperate with the internal threading 285 on bushing piece 271 whereby interconnecting the pieces 271, 273 to each other. A radial and preferably annular shoulder 286' is formed at the conjuncture of the shank portion 282' and head portion 284'. In this form, the head portion 284' of bushing piece 273 is configured and sized to inhibit it from passing into the bore 257 of strut 36. Suitable rotation of bushing pieces 273 relative to bushing piece 271 will serve to establish the interconnection therebetween.

As will be appreciated, the configuration of the bearing pieces 271 and 273 forming each bushing 270, 272 can be reversed without detracting or departing from the true spirit and novel concept of the disclosure. That is, bushing piece 271 can be configured to journal that portion of the brake lever pivot pin passing therethrough and bushing piece 273 can be layered in external relation relative to bushing piece 271 so as to be accommodated within the bore 257 of the strut 36 without detracting or departing from the spirit and novel concept of the present disclosure. Although not shown, the inner end of the strut bore 257 (closest to the strut axis 46) can be configured with a counterbore configuration whereby allowing the head portion 284 of bushing piece 271 to be seated and accommodated therein so as to increase the spacing between the brake pin bushings 270, 272 (FIG. 12) and thereby avoiding any potential interference with rotation of the brake lever 42 (FIG. 4) during operation of the railcar brake beam assembly 30.

Figure 14:
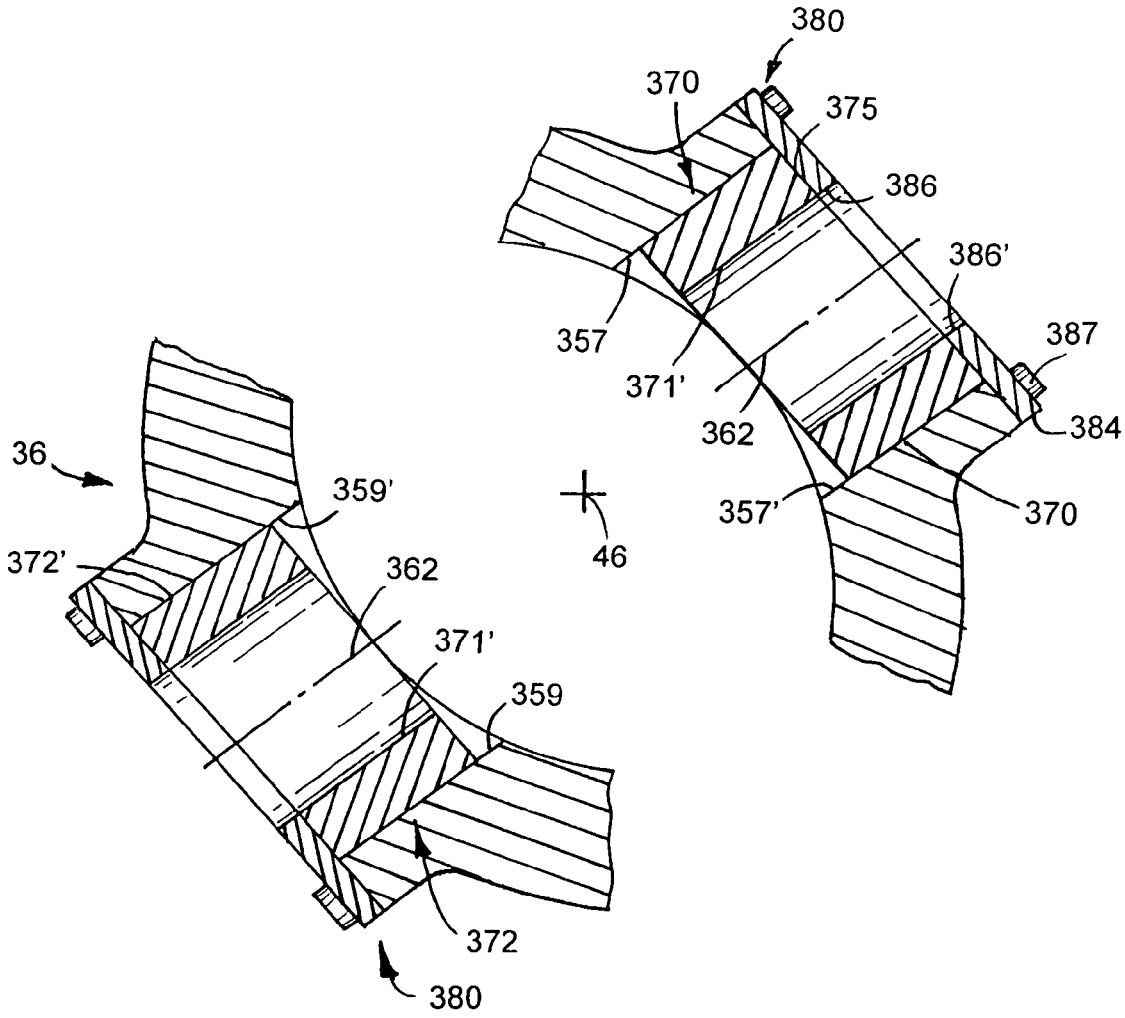
FIG. 14 is a fragmentary and enlarged sectional view similar to FIG. 6 showing an alternative brake pin bushing arrangement.

FIG. 14 illustrates yet another form of a brake beam strut having bushings for journalling the brake lever pivot pin and which is specifically configured to limit inadvertent axial displacement or movement of either brake pin bushing relative to the strut 36 and away from the longitudinal axis 46 of the strut 36. This alternative form of brake pin bushing is designated generally in FIG. 14 by reference numerals 370 and 372. The elements of the strut arranged in operable combination with the this alternative form of brake pin bushing that are functionally analogous to those component discussed above regarding bushings 70 and 72 are designated by reference numerals identical to those listed above with the exception this embodiment uses reference numerals in the 300 series.

In the embodiment shown in FIG. 14, the bushings 370 and 372 are substantially identical relative to each other with bushing 370 being accommodated in bore 357 of strut 36 and bushing 372 being accommodated in bore 359 of strut 36. Preferably, each brake pin bushing 370, 372 has a generally cylindrical outer periphery. As such, each brake pin bushing 370 and 372 has an outer diameter 370' and 372', respectively. Notably, the outer diameter 370', 372' of the respective brake pin bushings 370, 372 are sized such that a press fit is established between the periphery or outer diameter 370', 372' of the brake pin bushings 370, 372 and the inner diameter 357', 359' of the respective bores 357, 359 into which the brake pin bushings 370, 372 are pressed. The inner diameter 371' of each brake pin bushing 370, 372 is sized to journal that portion of the brake lever pivot pin passing therethrough for rotation about a fixed axis 362.

To inhibit inadvertent displacement of bushings 370, 372 away from the longitudinal axis 46, the strut 36 shown in FIG. 14 further includes cooperating instrumentalities, generally identified by reference numeral 380. Since the cooperating instrumentalities 380 for inhibiting axial movement of the brake pin bushings 370, 372 away from the longitudinal strut axis 46 are substantially the same, only the cooperating instrumentalities 380 for inhibiting axial movement of the brake pin bushing 370 away from longitudinal strut axis 46 will be discussed in detail.

As shown in FIG. 14, and after each brake pin bushing is arranged within the respective bore of strut 36, a plate or stop member 384 having an aperture 386 is secured to an exterior of the strut 36 in juxtaposed or adjacent relation with the end 375 of the bushing 370 disposed farthest from the longitudinal axis 46 of the strut 36. As will be appreciated, plate 384 can be secured to an exterior of the strut 36 using any suitable means including adhesive and/or suitable mechanical fasteners 387. As shown in FIG. 14, the aperture or opening 386 in plate 384 preferably has a closed margin defining an inner diameter 386' which is greater than the inner diameter 371' of bushing 370 but less than the outer diameter 370' of bushing 370. Suffice it to say, the inner diameter 386' of the aperture or opening 386 in plate 384 is sized to allow the brake lever pivot pin 60 (FIG. 4) to pass therethrough while inhibiting the adjacent brake pin bushing from moving therepast. As such, the plate 384 limits inadvertent axial displacement of the brake pin bushing 370 away from the longitudinal axis 46 of strut 36.

Figure 15:
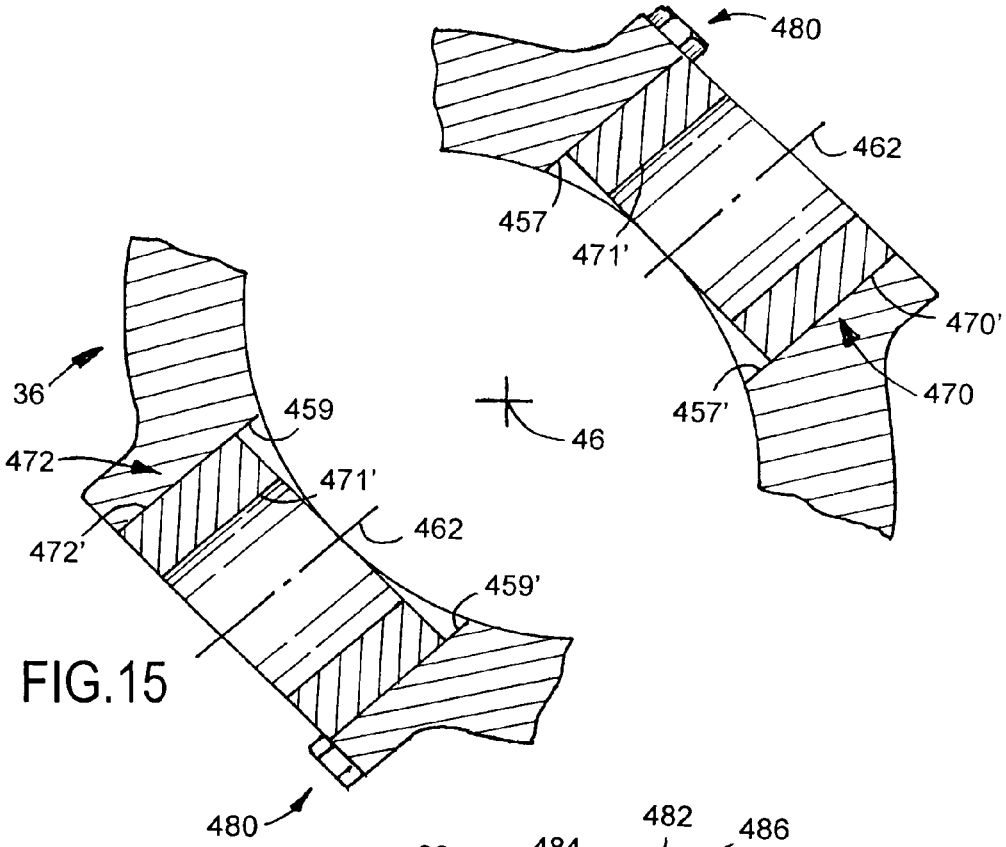
FIG. 15 is a fragmentary and enlarged sectional view similar to FIG. 6 showing yet another alternative brake pin bushing arrangement.
Figure 16:
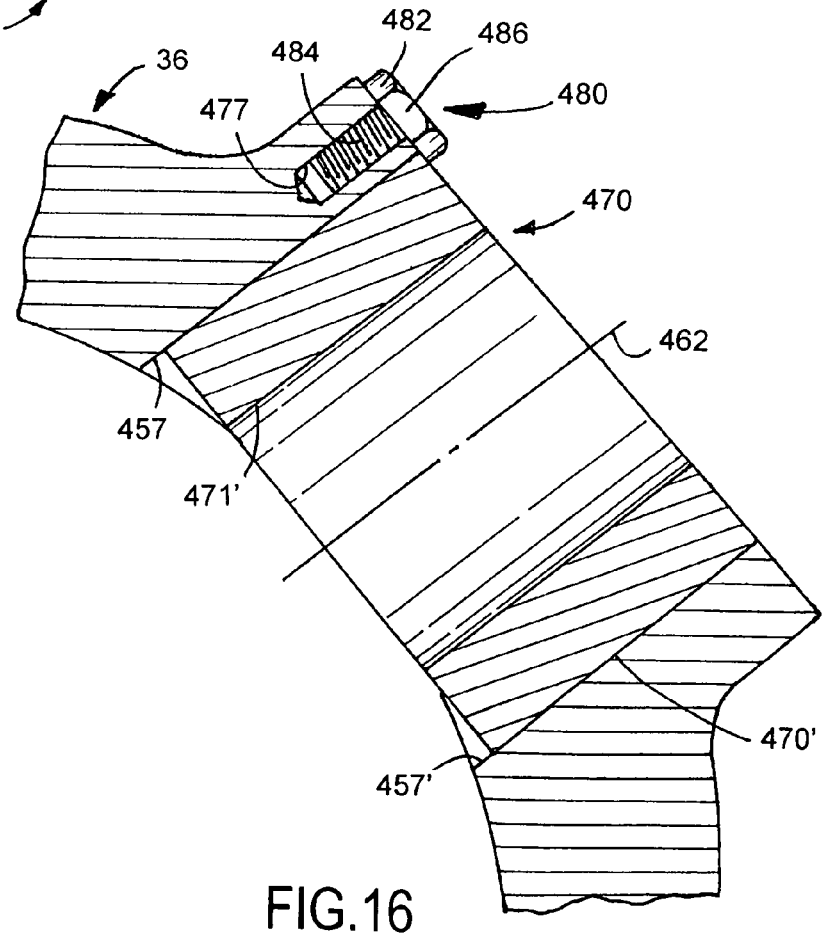
FIG. 16 is a fragmentary and enlarged longitudinal sectional view of one of the brake pin bushings shown in FIG. 15.

FIGS. 15 and 16 illustrate still another form of a brake beam strut specifically configured to inhibit inadvertent axial displacement of either brake pin bushing relative to the strut 36 and away from the longitudinal axis 46 of the strut 36. This alternative form of brake pin bushing is designated generally in FIGS. 15 and 16 by reference numerals 470 and 472. The elements of the strut arranged in operable combination with the this alternative form of brake pin bushing that are functionally analogous to those component discussed above regarding bushings 70 and 72 are designated by reference numerals identical to those listed above with the exception this embodiment uses reference numerals in the 400 series.

In the embodiment shown by way of example in FIGS. 15 and 16, the bushings 470 and 472 are substantially identical relative to each other with bushing 470 being accommodated in bore 457 of strut 36 and bushing 472 being accommodated in bore 459 of strut 36. Preferably, each brake pin bushing 470, 472 has a generally cylindrical outer periphery. As such, each brake pin bushing 470 and 472 has an outer diameter 470' and 472', respectively. Notably, the outer diameter 470', 472' of the respective brake pin bushings 470, 472 are sized such that a press fit is established between the outer diameter 470', 472' of the brake pin bushings 470, 472 and the inner diameter 457', 459' of the respective bores 457, 459 into which the brake pin bushings 470, 472 are pressed. The inner diameter 471' of each brake pin bushing 470, 472 is sized to journal that portion of the brake lever pin passing therethrough for rotation about axis 462.

To inhibit inadvertent displacement of the bushings 470, 472 away from the longitudinal axis 46, the strut 36 shown in FIGS. 15 and 16 further includes cooperating instrumentalities, generally identified by reference numeral 480. Since the cooperating instrumentalities 480 for inhibiting inadvertent axial displacement of the brake pin bushings 470, 472 away from the longitudinal axis 46 of strut 36 are substantially the same, only the cooperating instrumentalities 480 for limiting axial movement of the brake pin bushing 470 will be discussed in detail.

As shown in FIG. 16, and after brake pin bushing 470 is arranged within the bore 457 of strut 36, a fastener 482 is secured to an exterior of the strut 36. In the example shown in FIG. 16, fastener 482 has a threaded shank portion 484 and an enlarged head 486. The threaded shank portion 484 of fastener 482 is accommodated within a threaded bore 477 defined by strut 36 in predetermined radial relation relative to the inner diameter 457' of the brake pin bushing receiving bore 457 in the strut 36. When fastener 482 is threaded into bore 477, at least a portion of the head 486 of fastener 482 is configured to extend radially past the inner diameter 457' of the brake pin bushing receiving bore 457 in the strut 36. As such, the head 486 of fastener 484 limits axial displacement of the brake pin bushing 470 away from the longitudinal axis 46 of strut 36.

Regardless of which variety of brake pin bushing design is utilized in combination with the brake beam assembly strut, and although the brake pin bushings are inclined a predetermined number of degrees from vertical, the cooperating instrumentalities associated with each brake pin bushing serves to limit inadvertent axial displacement of the bushings away from the centerline of the brake beam assembly strut. As such, the brake beam bushings are maintained in operable combination with the strut thereby providing enhanced performance for the brake beam assembly. Moreover, the ability to maintain the brake pin bushings in operable combination with the strut while inhibiting axial shifting of the brake pin bushings away from the centerline of the strut offers enhanced durability to the bushings at a minimal cost. Additionally, the ability to maintain the brake pin bushings in operable combination with the strut while limiting the axial displacement of the brake pin bushings away from the centerline of the strut during operation of the railcar brake assembly and otherwise provides the brake lever, moving about the brake lever pivot pin journalled by the bushings, with a relatively constant axis about which to pivot thereby offering consistent performance of the brake beam assembly during operation. These and other objects, aims and advantages of the present disclosure are all provided with minimal costs and simplistic design changes.

From the foregoing, it will be observed that numerous modifications and variations can be made and effected without departing or detracting from the true spirit and novel concept of the present disclosure. Moreover, it will be appreciated, the present disclosure is intended to set forth an exemplifications which are not intended to limit the disclosure to the specific embodiment illustrated. Rather, this disclosure is intended to cover by the appended claims all such modifications and variations as fall within the spirit and scope of the claims.

What is claimed is:

1. A railroad freight car brake beam assembly having two ends, with each end of the brake beam assembly having a brake shoe carried by a brake head, said brake beam assembly comprising:

a tension member and compression member arranged in a truss configuration relative to each other, with said tension member and said compression member having one of said brake heads connected toward distal ends thereof; and an elongated strut operably connected at opposite ends to and between said tension member and said compression member, said strut having a longitudinal centerline and a closed ended slot defined between first and second joined walls of said strut, with each wall of said strut having interior and exterior surfaces separated by a predetermined distance, with the slot in said strut being inclined a predetermined number of degrees from vertical for accommodating an elongated brake lever extending through said strut, and with each wall of said strut defining a bore opening to the slot and to the exterior surface of said strut, with the bores defined by the walls on said strut being aligned relative to each other to accommodate a pivot pin extending through said strut thereby connecting the brake lever to said strut and so as to define a pivot axis about which said brake lever pivots; and with one tubular metal bushing being fitted into each bore defined by each wall of the strut for journalling said pivot pin for rotation about said pivot axis, with each tubular bushing having an inner terminal end along with a spaced and generally parallel outer terminal end, with the inner terminal end of each bushing, after said bushing is inserted into operable combination with said strut, being disposed closer to the longitudinal axis of said strut than is said outer terminal end, and wherein the spacing between said inner and outer terminal ends of each bushing is generally equal to or less than the predetermined distance separating said interior and exterior surfaces of a respective strut wall wherein said bushing is fitted, and with each tubular bushing including a series of circumferentially spaced splines which, after said bushings are inserted into operable combination with said strut, extend generally parallel to said pivot axis and about an outer surface of each bushing, with each spline on each tubular bushing having a length extending a majority of an axial distance separating the inner and outer terminal ends of each bushing and has a substantially constant root diameter and a substantially constant peak diameter along the length thereof, with the root diameter of diametrically opposed splines on the outer surface of each bushing being sized smaller than the inside diameter of the respective bore in the wall of the strut, and wherein the peak diameter of diametrically opposed splines on the outer surface of each tubular bushing being sized greater than an inner diameter of the respective bore in the wall of the strut such that when said bushing is pressed into the respective bore in the strut the splines thereon displace strut material and create a mechanically interrupted mating area disposed to each side of, in contact with and extending generally parallel to the pivot axis and along at least a lengthwise portion of a plurality of said splines while allowing said splines to maintain a constant configuration such that said strut and each bushing coact with each other to inhibit rotation of the bushing relative to the strut and inhibit inadvertent axial displacement of the bushings away from said centerline and relative to said strut during operation of said brake beam assembly thereby fixing the pivot axis of said brake lever relative to said strut.

2. The railroad freight car brake beam assembly according to claim 1, wherein a majority of the splines in said series of splines have a helical configuration.

3. A railroad freight car strut assembly comprising:

an elongated strut having a longitudinal centerline and a closed ended slot defined between first and second joined walls of said strut, with each wall of said strut having interior and exterior surfaces separated by a predetermined distance, with the slot in said strut accommodating an elongated brake lever extending through said strut, and with each wall of said strut defining a bore opening to the slot and to the exterior surface of said strut, with the bores defined by the walls on said strut being aligned relative to each other to accommodate a pivot pin extending through said strut thereby connecting the brake lever to said strut and so as to define a pivot axis about which said brake lever pivots; and with one tubular metal bushing being fitted into each bore defined by each wall of the strut for journalling said pivot pin for rotation about said pivot axis, with each tubular bushing having an inner terminal end along with a spaced and generally parallel outer terminal end, with the inner terminal end of each bushing, after said bushing is inserted into operable combination with said strut, being disposed closer to the longitudinal axis of said strut than is said outer terminal end, and wherein the spacing between said inner and outer terminal ends of each bushing is generally equal to or less than the predetermined distance separating said interior and exterior surfaces of a respective strut wall wherein said bushing is fitted, and with each tubular bushing including a series of circumferentially spaced splines which, after said bushings are inserted into operable combination with said strut, extend generally parallel to said pivot axis and about an outer surface of each bushing, with each spline on each tubular bushing having a length extending a majority of an axial distance separating the inner and outer terminal ends of each bushing and has a substantially constant root diameter and a substantially constant peak diameter along the length thereof, with the root diameter of diametrically opposed splines on the outer surface of each bushing being sized smaller than the inside diameter of the respective bore in the wall of the strut, and wherein the peak diameter of diametrically opposed splines on the outer surface of each tubular bushing being sized greater than an inner diameter of the respective bore in the wall of the strut such that when said bushing is pressed into combination with an inner surface of the respective bore in said strut the splines thereon displace strut material and create a mechanically interrupted mating area disposed to each side of, in contact with and extending generally parallel to the pivot axis and along at least a lengthwise portion of a plurality of said splines while allowing said splines to maintain a constant configuration such that said strut and each bushing coact with to each other to inhibit rotation of the bushing relative to the strut and inhibit inadvertent axial displacement of the bushings away from said centerline and relative to said strut during operation of said brake beam assembly thereby fixing the pivot axis of said brake lever relative to said strut.

4. The railroad freight car strut assembly according to claim 3, wherein a majority of the splines in said series of splines have a helical configuration.

* * * * *